US005222730A

United States Patent [19]

Miyake

[11] Patent Number: 5,222,730

[45] Date of Patent: Jun. 29, 1993

[54] SHEEET CONVEYOR JOINT MECHANISM

[75] Inventor: Takashi Miyake, Osaka, Japan

[73] Assignee: Mita Industrial Co., Ltd., Osaka, Japan

[21] Appl. No.: 798,179

[22] Filed: Nov. 26, 1991

[30] Foreign Application Priority Data

Nov. 26, 1990 [JP] Japan ..... 2-323453

[51] Int. Cl.[5] ..... B65H 31/24

[52] U.S. Cl. ..... 271/296; 271/302

[58] Field of Search ..... 271/272, 273, 292, 296, 271/302, 306, 200, 207

[56] References Cited

U.S. PATENT DOCUMENTS 4,580,775 4/1986 Maruyama ..... 271/296 X
4,822,025 4/1989 Chung ..... 271/296
4,900,009 2/1990 Kitahara ..... 271/296
5,078,385 1/1992 Serita ..... 271/296
5,101,241 3/1992 Watanabe ..... 271/200 X

*Primary Examiner*—Richard A. Schacher
*Attorney, Agent, or Firm*—Cushman, Darby & Cushman

[57] ABSTRACT

A sheet conveyor joint mechanism comprises: frames for connecting a first sheet processing unit to a second sheet processing unit; and a sheet carrying mechanism provided in the frames and having a sheet intake portion of a carrying path for carrying sheets which is positionally adjustable relative to a sheet discharging portion of the first sheet processing unit and/or a sheet discharging portion of the carrying path which is positionally adjustable relative to a sheet intake portion of the second sheet processing unit.

15 Claims, 6 Drawing Sheets

SHEEET CONVEYOR JOINT MECHANISM

BACKGROUND OF THE INVENTION

The present invention relates to a joint mechanism adapted to connect a first sheet processing unit and a second sheet processing unit such as a photocopying machine and a sorter.

There are generally two types of copying machines, namely a console type (a main body of a copying machine and a mount base for supporting it are integrally formed) and a desk top type (a main body of a copying machine and a mount base for supporting it are separately formed).

A sorter adapted to suitably sort sheets copied by copying machines is also frequently employed. Using a console type sorter with a desk top type copying machine is sometimes desirable, however. In such a case, there is a problem in that since the height of a portion for intake sheets to the sorter cannot be adjusted, the sorter of the console type copying machine cannot be employed with the desk top type copying machine unless the sorter is suitably placed upon a height-adjustable desk.

SUMMARY OF THE INVENTION

Accordingly, it is an object of the present invention to provide a sheet conveyor joint mechanism by means of which a sorter for a console type copying machine can be readily employed with a desk top type copying machine.

A sheet conveyor joint mechanism according to the present invention comprises frames for connecting a first sheet processing unit to a second sheet processing unit, a sheet carrying mechanism provided therein having a sheet intake portion of a carrying path for carrying sheets whose position can be adjusted relative to a sheet discharging portion of the first sheet processing unit and having a sheet discharging portion of the carrying path whose position can be adjustable relative to a sheet intake portion of the second sheet processing unit.

The sheet carrying mechanism is provided with carrying plates rotatably supported by support shafts mounted on the frames and also with securing means for fixedly securing the carrying plates to the frames at prescribed positions of rotation.

The sheet intake portion of the sheet carrying mechanism can be positionally adjusted relative to the sheet discharging portion of the first sheet processing unit, and the sheet discharging portion of the sheet carrying mechanism can be positionally adjusted relative to the sheet intake portion of the second sheet processing unit. Thus, the first sheet processing unit and the second sheet processing unit can be freely connected to each other regardless of the height of the sheet discharging portion or the sheet intake portion.

DETAILED DESCRIPTION OF THE PREFERRED EMBODIMENT

An embodiment of the present invention will be described in more detail with reference to the accompanying drawings.

Figure 1:
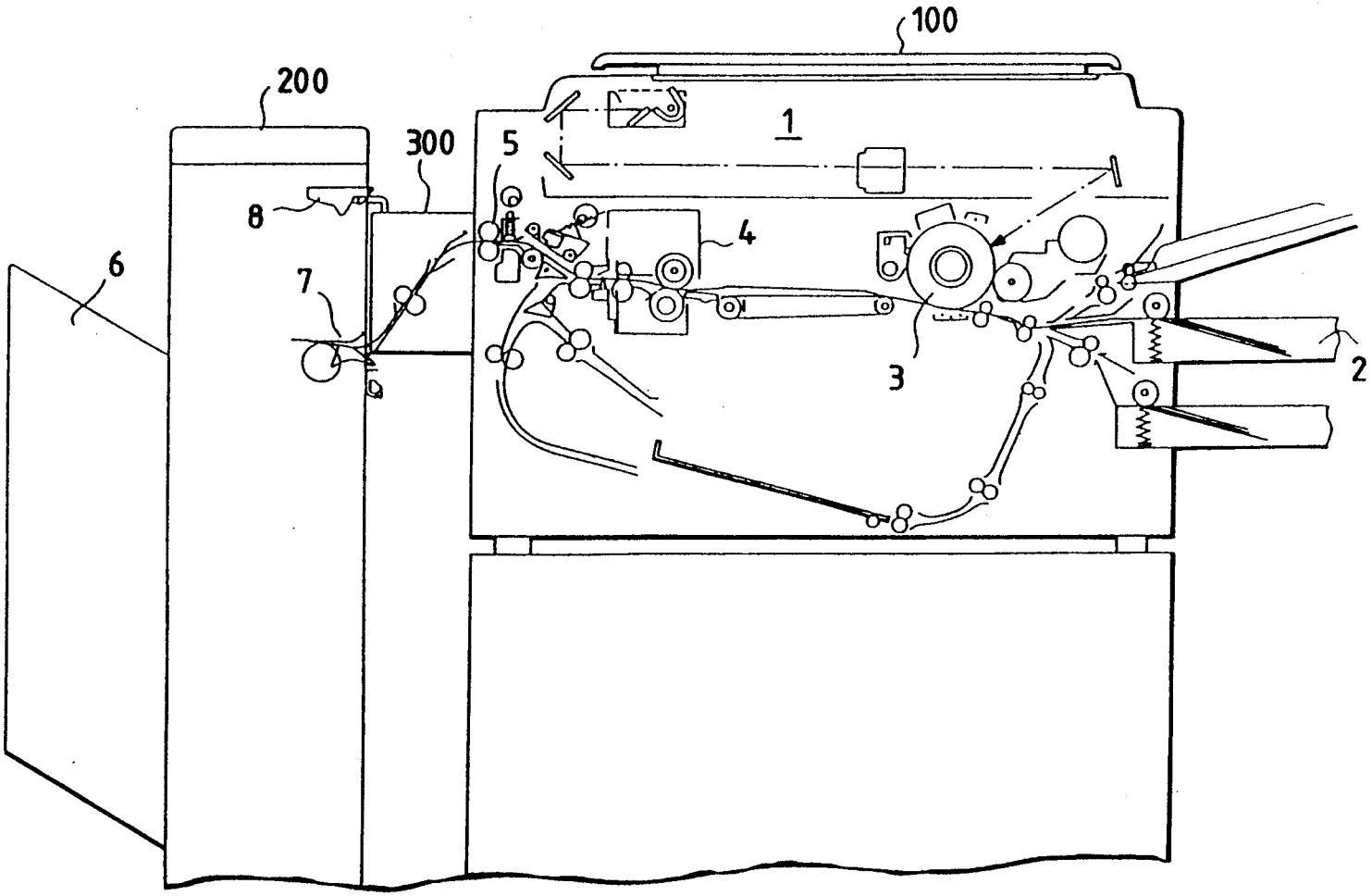
FIG. 1 is a front view of a copying machine arrangement showing a sheet conveyor joint mechanism according to an embodiment of the present invention.

FIG. 1 is a front view of a copying machine arrangement including copying machine 100, a sorter 200 and an embodiment of the sheet conveyor joint mechanism 300 according to the present invention.

The copying machine 100 comprises an optical system 1 for imaging an original, a sheet supply bin 2 for supplying paper sheets, an image formation portion 3 for developing and transferring the image onto the sheet, a fixing portion 4 for thermally fixing the image-formed sheet and a sheet discharging portion 5 for discharging the sheets.

The sorter 200 comprises a sheet intake portion 7 for retrieving the sheets and a bin tray 6 for storing the sorted sheets.

The sheet conveyor joint mechanism 300 is secured to the discharging portion 5 of the copying machine 100 and engaged by a hook 8 of the sorter 200.

Figure 2:
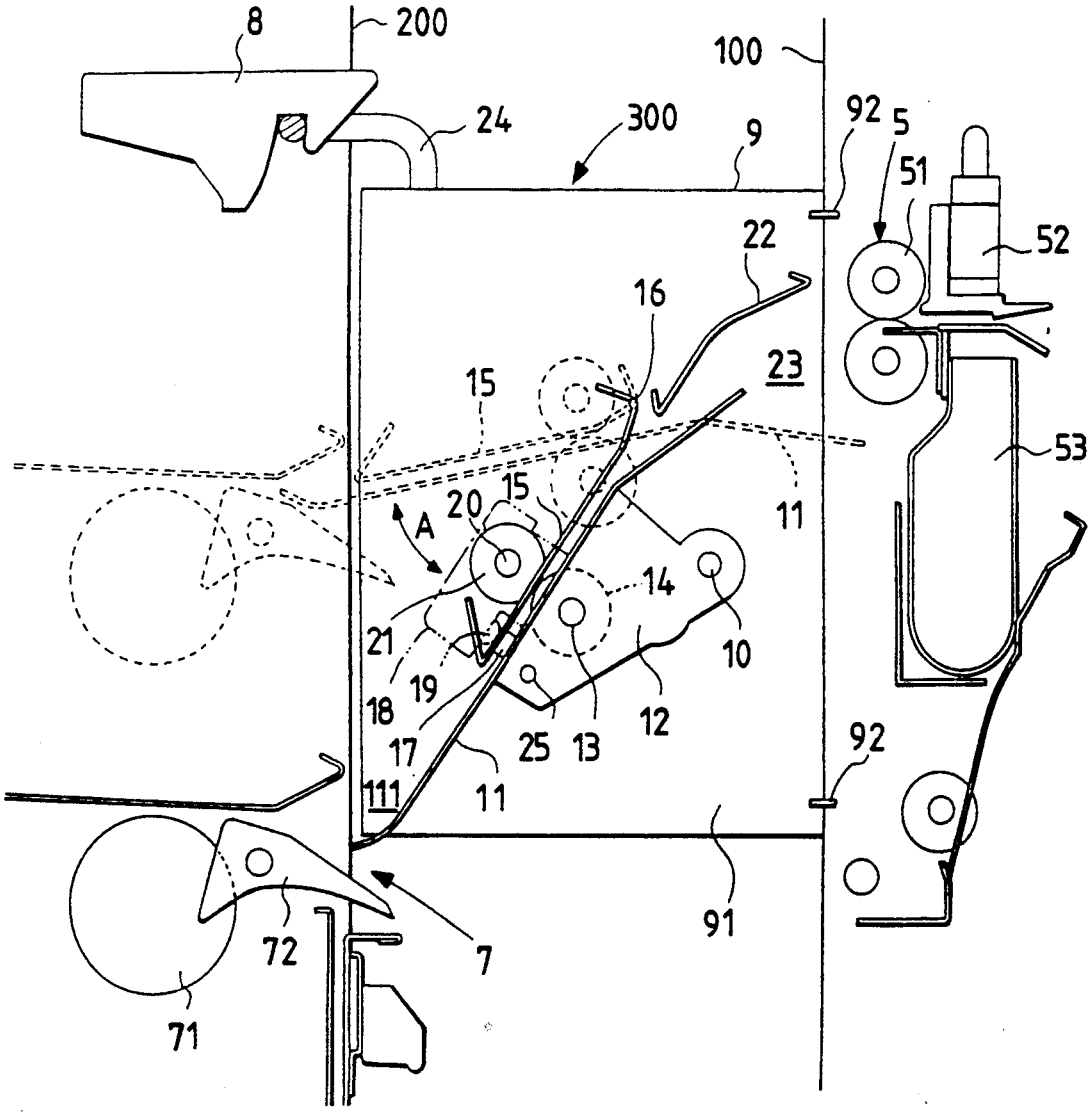
FIG. 2 is an enlarged, schematic section view showing this sheet conveyor joint mechanism.

FIG. 2 is an enlarged schematic section view of the sheet conveyor joint mechanism 300 which is centrally shown.

Frames 9 of the sheet conveyor joint mechanism 300 are secured to the sheet discharging portion 5 of the copying machine 100 by means of screws 92. A support shaft 10 is mounted on the side plates 91 of the frames 9. A lower carrying plate 11 for carrying the sheet is rotatably mounted onto the support shaft 10 by brackets 12. A plurality of rubber carrying rollers 14 are rotatably disposed on a shaft 13 which is secured to brackets 12. The upper portions of the carrying rollers 14 protrude through a plurality of cut-out apertures formed in the lower carrying plate 11. Securing pins 25 for securing the lower carrying plate 11 to the frames 9 are uprightly and outwardly disposed on the lower portions of the brackets 12. At opposite sides of upper portions of the brackets 12 are uprightly provided another pair of brackets 18 shown by dotted lines.

An upper carrying plate 15 is disposed above the lower carrying plate 11 and rotatably held by a shaft 16 which is rotatably fitted into holes formed on the side plates 91 of the frames. Base pieces 17 are fixed to both side edges of the lower ends of the upper carrying plate 15 so as to form a space with a prescribed distance between the upper carrying plate 15 and the lower carrying plate II. The sheets are carried in this space between the upper carrying plate 15 and the lower carrying plate II. The springs 19 by which the upper carrying plate 15 is pressed so as to not float upward are attached to the lower portions of the brackets 18. The distance of the space formed between both the carrying plates 11, 15 is, therefore, kept constant.

A plurality of cut-out apertures in the upper carrying plate 15 are formed through which protrude the lower portions of a plurality of upper carrying rollers 21 made of plastic. The carrying rollers 21 are axially supported on a shaft 20 fixed to the brackets 18. The upper carrying rollers 21 and the lower carrying rollers 14 together serve to move the sheets through the joint mechanism. Broken lines 11, 15 indicate a state in which these carrying plates are in their upward positions.

Near the upper end portions of these upper and lower carrying plates 11, 15 is provided a fixed carrying plate 22 fixed to the frame 9. The fixed carrying plate 22 and the upper end of the lower carrying plate 11 together constitute a sheet intake portion 23. This sheet intake portion 23 is positionally adjusted relative to the sheet discharging portion 5 of the copying machine 100. More precisely, the sheet intake portion 23 is positionally adjusted by threading the securing pins 25 to the side plates 91 so that the tip of the sheet discharged from discharging rollers 51 is guided by the fixed carrying plate 22 and then carried into the space between the upper carrying plate 15 and the lower carrying plate 11. Reference numerals designate a discharging roller 51, a puncher 52 and a punched waste storing tank 53.

In the sheet intake portion 7 of the sorter 200 is positioned a lower end (sheet discharging portion 111) of the lower carrying plate 11.

Reference numeral 71 denotes a sheet intake roller and numeral 72 designates a sheet intake claw.

A fixture rod 24 of a "U" shape is mounted on the upper portion of the frame 9 adjacent to the sorter 200. The engaging hook 8 is provided at the side of the sorter 200 for engaging with the copying machine 100 and is adapted in order to engage with the fixture rod 24.

Figure 3:
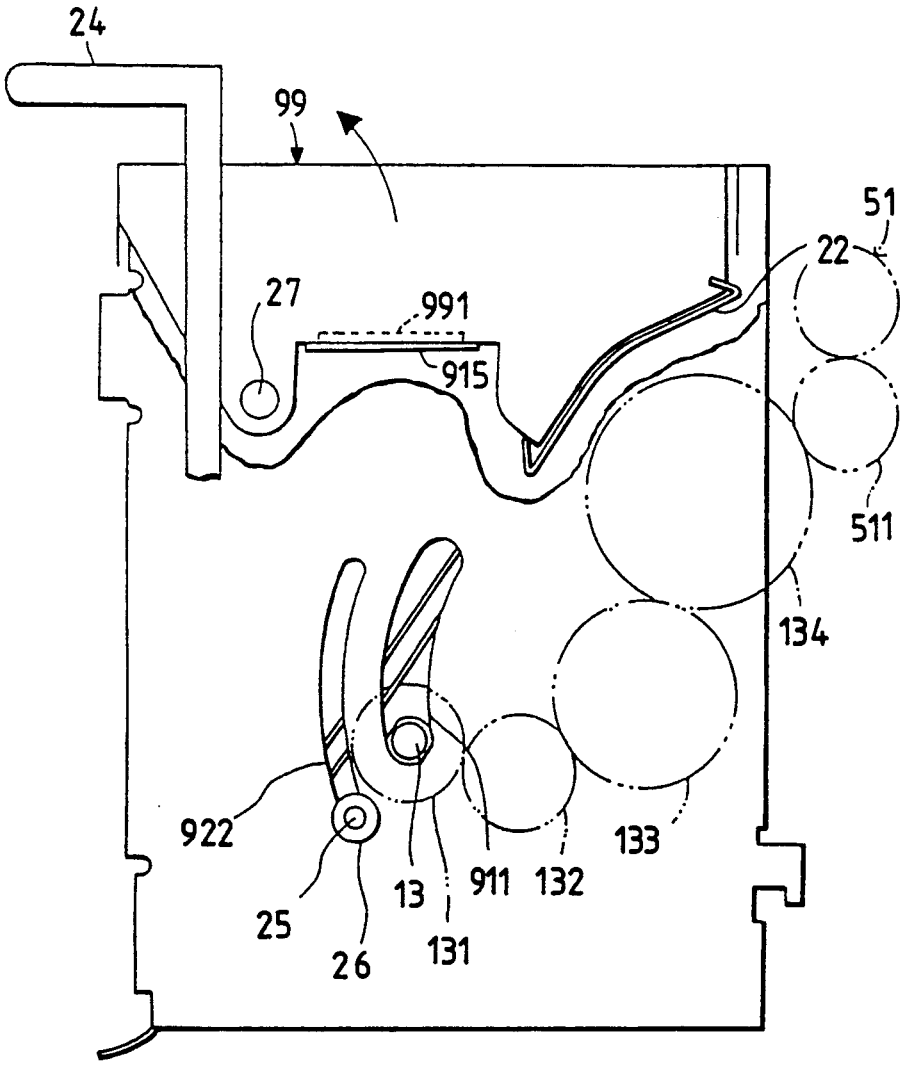
FIG. 3 is a partly fragmented front view of the sheet conveyor joint mechanism.

FIG. 3 is a partly fragmented side view seen from the outside of frame 9. A slot 911 is formed on each of the side plates 91 through which the end portions of the shaft 13, secured to the bracket 12, are exposed outward. The configuration of the slot 911 is predetermined in a range where the shaft 13 moves. When a driving force is externally transmitted to the shaft 13, the lower carrying rollers 14 are thereby rotated and the upper carrying rollers 21 are driven in turn to rotate.

The transmission of the driving force is described here in more detail. The shaft 13 is designed to rotate synchronously with the driving of the copying machine 100 side in accordance with the transmission of the driving force through gears 131, 132, 133, 134 and a discharging roller gear 511. At this time, the carrying speed of the upper and lower carrying rollers 14, 21 is so predetermined as to be equal to the sheet carrying speed of the discharging roller 51.

A slot 922 is formed on each of the side plates 91 through which the tip end of the pin 25 protruding from and attached to the lower portion of the bracket 12 is exposed outwardly. The configuration of the slot 922 is predetermined in a range where the pin 25 moves. A screw 26 is threaded to the tip end of the pin 25. The collar portion of the screw 26 is pressed to the peripheral edge of the slot 922 by fastening the screw 26, so that the pin 25, the bracket 12, and the lower carrying plate 11 and the upper carrying plate 15 can be secured to the frame 9 under the influence of the pressure of the screw 26.

An upper portion 99 of the frame 9 including the fixed carrying plate 22 can be turned upward and opened about a shaft 27. When open, it is held on the horizontal portion of the fixture rod 24 to keep it in an open state. Removing the jammed sheets can be readily done, therefore, when the sheets are jammed in the frames 9.

Figure 7:
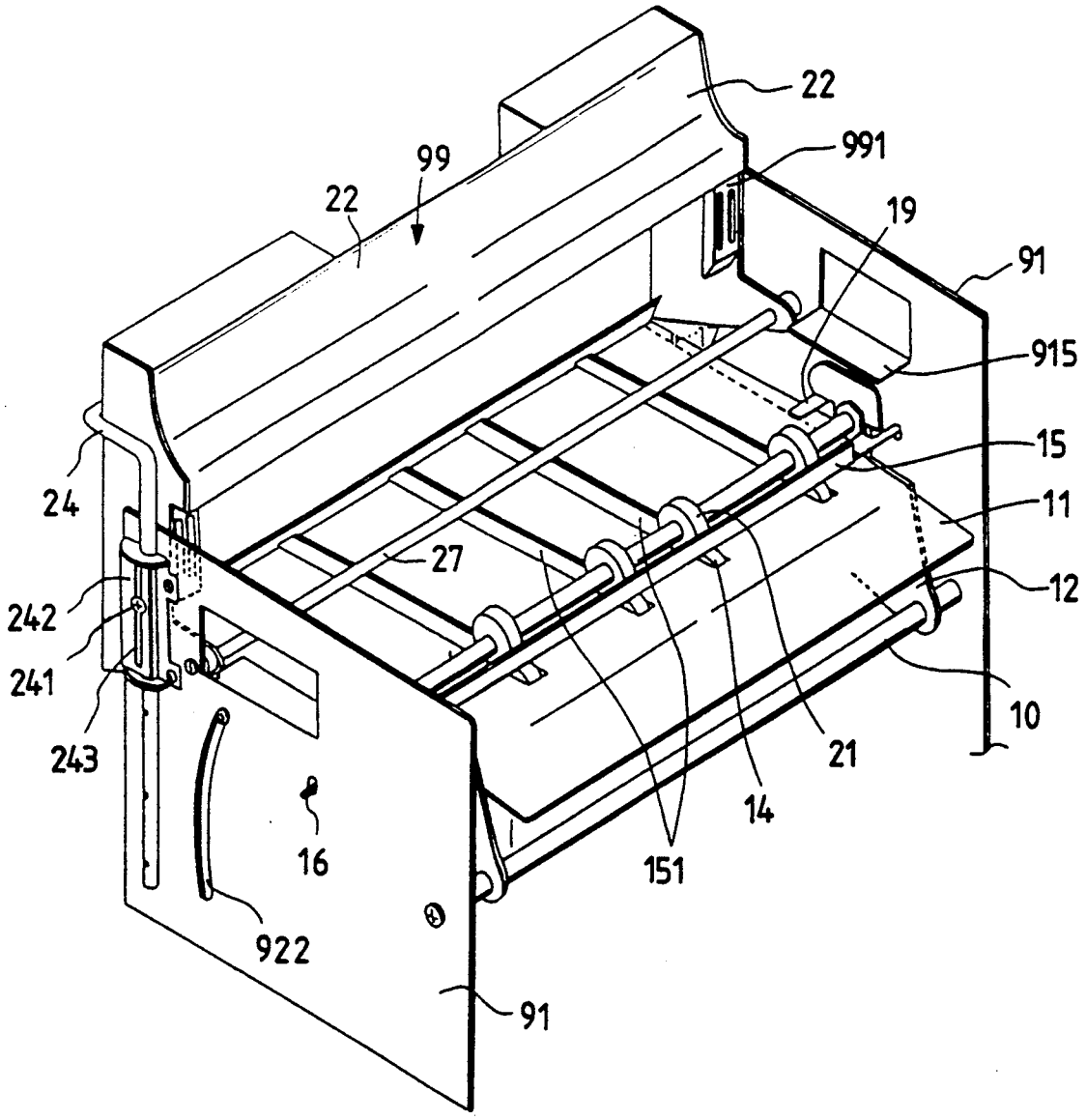
FIG. 7 is a perspective view of the sheet conveyor joint mechanism with an upper portion thereof opened.

FIG. 7 is a perspective view seen from an upper portion of the upper side-opened sheet conveyor joint mechanism. As can be seen from the drawing, a portion 915 of each of the side plates 91 is bent inwardly. A magnet 991 provided on the upper portion 99 is magnetically affixed thereto so as to hold upper portion 99 tightly closed. The height of the fixture rod 24 can be freely adjusted relative to the side plate 91. Namely, a holding member 242 which is fixed to the side plate 91, through which a fixture rod 24 passes and on which a slit 243 is formed, and a pivot 241 inserted into the slit 243 so as to press the fixture rod 24, enables the fixture rod 24 to be secured at a desired height. Reference numeral 151 designates a cut-out aperture adapted to permit each of the carrying rollers to be moved when the upper carrying plate 15 is rotated.

Figure 4:
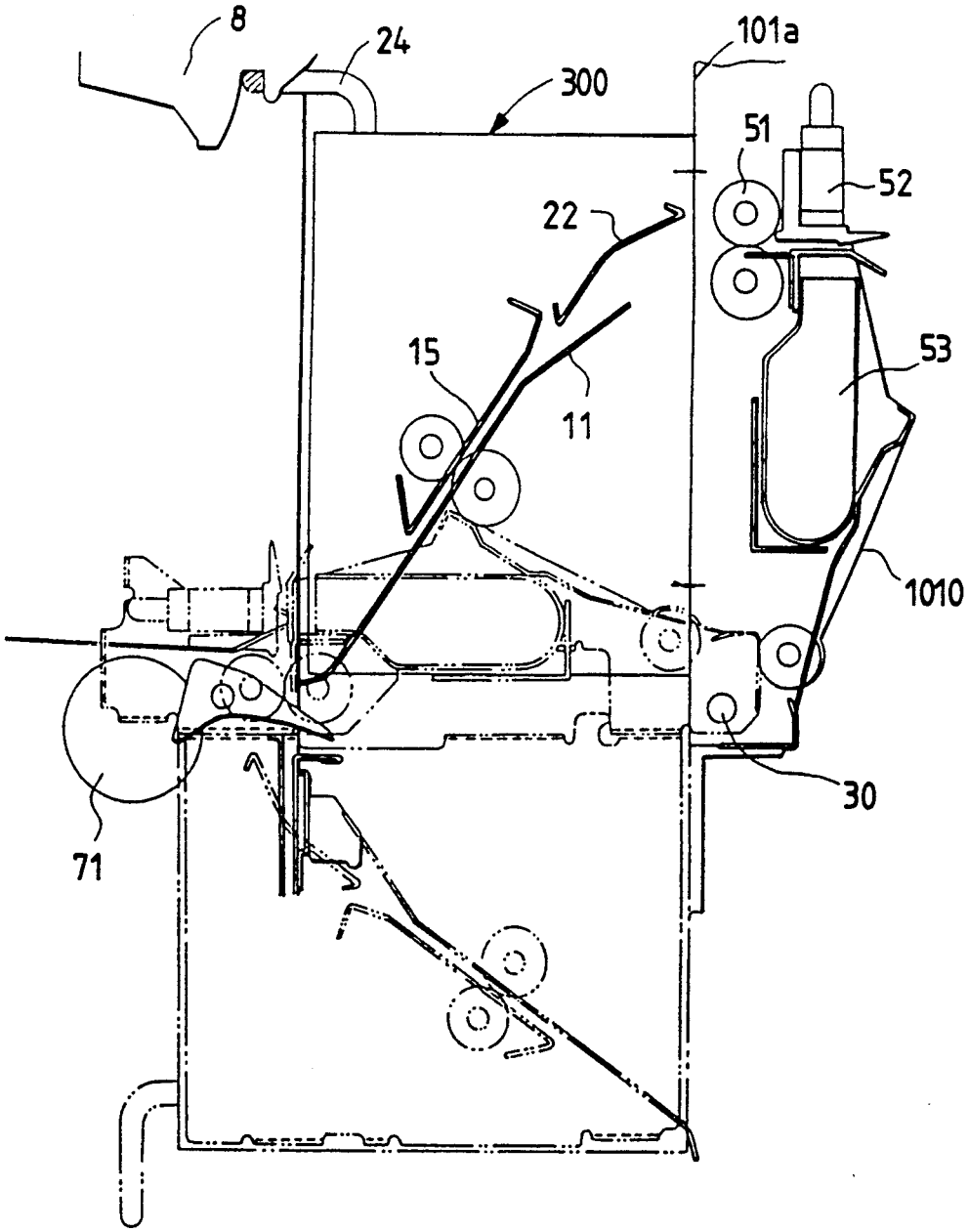
FIG. 4 is a schematic section view showing the operation of the sheet conveyor joint mechanism.
Figure 5:
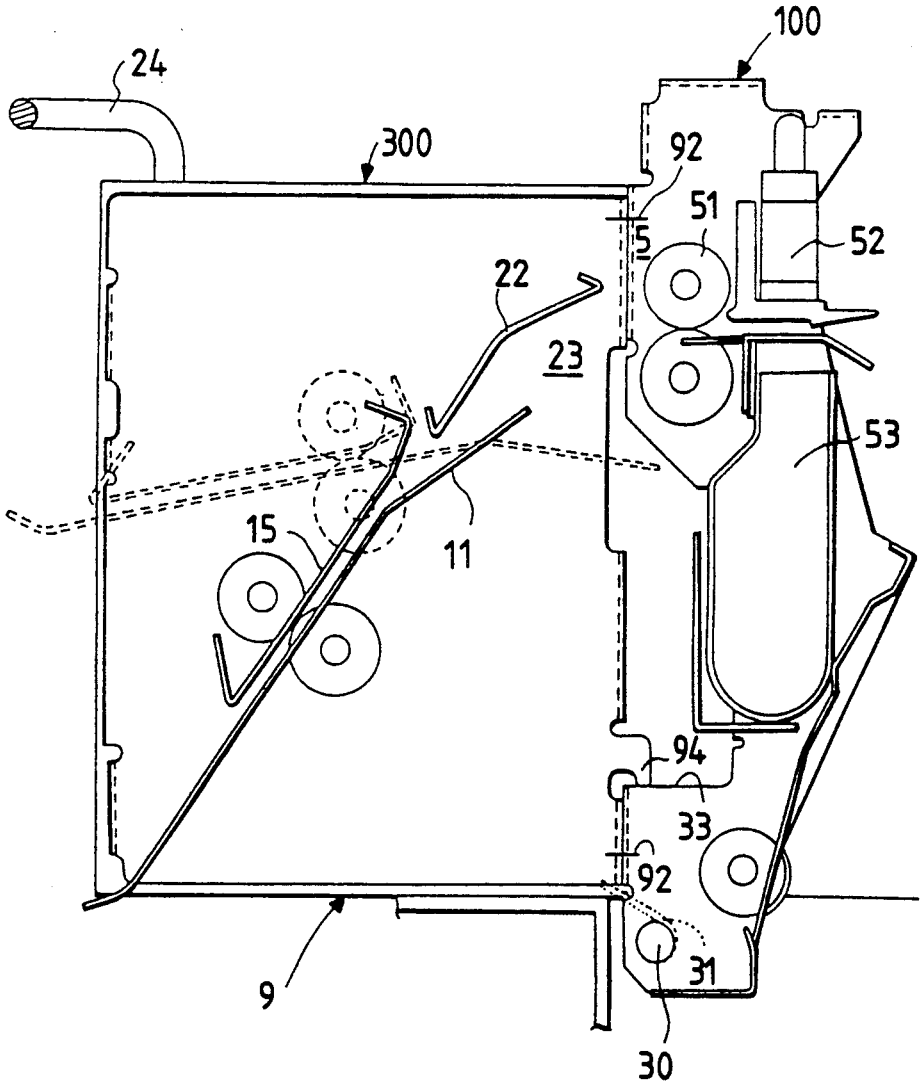
FIG. 5 is a schematic section view of a unit portion of the sheet conveyor joint mechanism and a copying machine.
Figure 6:
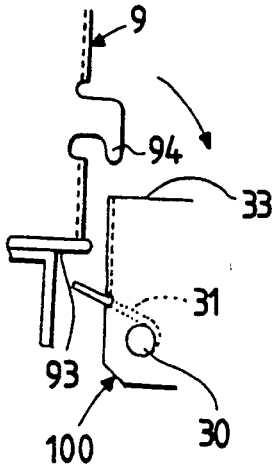
FIG. 6 is a schematic section view illustrating the assembly of the unit portion of the sheet conveyor joint mechanism and the copying machine.

As shown in FIG. 4, the discharging roller 51, the puncher 52, the tank 53, etc., of the copying machine 100 and a part of a side plate 101*a* at a discharging side of the copying machine 100 are united to form a unit portion 1010. This unit portion 1010 is rotated outwardly together with the sheet conveyor joint mechanism 300 so as to be opened (refer to the dotted lines). Reference numeral 30 denotes its rotation support shaft. As shown in FIG. 5, a coil spring 31 adapted to resiliently support the opened unit portion 1010 and the sheet conveyor joint mechanism 300 is provided on the shaft 30. This coil spring 31 also plays an important role when the sheet conveyor mechanism 300 is attached to the copying machine 100, as described below. As can be seen in FIG. 6, an operator raises the frame 9 by hand, enabling access to the copying machine 100. At that time, a bottom face 93 of the frame 9 temporarily rests on the coil spring 31. Then, a protrusion 94 of the frame 9 is drawn nearer to and placed on a base portion 33 of a lower portion of the unit portion 1010. In this position, in which the protrusion 94 is placed on the base portion 33, the sheet conveyor joint mechanism 300 is secured to the copying machine 100 side by means of screws 92. The positions of the tapped holes of the screws 92 are so designed that the sheet intake portion 23 above the lower carrying plate II is aligned with the discharging portion 5. In the instance where the coil spring 31 is not provided (as in the conventional mechanism), the base portion 33 has to bear the entire weight of the sheet conveyor joint mechanism 300, making it difficult to readily detach the sheet convey mechanism 300 from the copying machine 100 side. In contrast, according to the present invention, the sheet conveyor joint mechanism 300 can be firmly supported in accordance with the position of the tip end and the influence of the spring force of the coil spring 31, such that the operation is conveniently and easily completed.

Next, the height of the sheet intake portion 7 of the sorter 200 is examined. In the case where it is located at a lower portion, as indicated by a solid line in FIG. 2, the screws 26 in the slot 922 formed on each of the side plates 91 of the frames 9 are unfastened, as shown in FIG. 3, before the sheet conveyor joint mechanism 300 is united with the sorter 200 and the pin 25 is moved upwardly and downwardly by hand. As a result, the brackets 21 secured to the side plates 91 by means of the pins 25, and the lower carrying plate 11 connected to the side plates through the brackets 12, move upwardly and downwardly while rotating about the support shaft 10, as shown in FIG. 2. When the lower carrying plate 11 moves, the upper carrying plate 15 likewise moves while sliding. Further, the lower carrying rollers 14 or the upper carrying rollers 21 similarly move together with the lower carrying plate 11 and the upper carrying plate 15 (refer to arrow A and dotted lines). Consequently, since the lower end portion of the lower carrying plate 11 moves upwardly and downwardly, a sheet discharging portion 111 is moved upwardly and downwardly. The lower and upper carrying plates Il, 15 are, therefore, moved to their proper positions. Then, each of the screws 26 is fastened and the pin 25 is fixed to the peripheral edge of the slot 922 at the positions of the carrying plates.

In such a way, at whatever height the sheet intake portion 7 of the sorter 200 may be positioned, the position of the sheet discharging portion 111 can be adjusted correspondingly.

After the height of the sheet discharging portion 111 is adjusted in this manner, the height of the fixture rod 24 is adjusted by unfastening the pivot 241, then, suitably moving the fixture rod 24 upwardly or downwardly, fastening the pivot and securing the fixture rod 24 to the side plate 91. After that, the hook 8 is engaged with the fixture rod 24 to thereby couple the sheet conveyor joint mechanism 300 to the sorter 200.

When a copying operation is carried out, the copied sheets are punched by the puncher 52 and discharged by the sheet discharging roller 51. The discharged sheets enter a portion between the fixed carrying plate 22 and the upper portion of the lower carrying plate 11, pass through the space between the lower carrying plate 11 and the upper carrying plate 15 and arrive at the sheet discharging portion 111. Then, the sheets are supplied to an inner portion from the sheet intake portion 7 of the sorter 200 and then sorted.

When the sheets jam, the upper portion of the frame 9 is opened upwardly together with the fixed carrying plate 22, as shown in FIG. 3, so that the jammed sheets can be removed.

In the case where the sheets jam in the sheet discharging portion 5 of the copying machine 100, the unit portion 1010 is rotated and opened together with the sheet conveyor joint mechanism 300, as shown in FIG. 4. When jamming of the sheets arises in the sheet intake portion 7 of the sorter 200, the hook 8 of the sorter 200 is disengaged from the fixture rod 24 and the sorter 200 is separated from the sheet conveyor joint mechanism 300 so that the jammed sheets can be removed.

As illustrated in the drawings, the distance for carrying the sheets from the sheet discharging portion 5 of the copying machine 100 to the carrying rollers 21, 14 of the sheet conveyor joint mechanism 300 is designed to become longer as the difference in height between the sheet intake portion 7 of the sorter 200 and the sheet discharging portion 5 becomes larger. As the difference in height between the sheet intake portion 7 and the sheet discharging portion 5 becomes larger, the extent of a sheet carried in a bent state increases. When the distance for carrying the sheet becomes shorter, it is difficult to properly guide the sheet to the carrying rollers 21, 14 so as to effectively catch it therebetween. Accordingly, as the extent of bending when the sheet is carried increases, (i.e., the difference in height between the sheet intake portion and the sheet discharging portion becomes larger), the distance for carrying the sheet is made longer, so that the sheet can be properly guided to the carrying rollers 21, 14 and thereby effectively be caught therebetween at any time.

Although the sheet discharging portion 5 of the copying machine 100 is positioned at a position higher than that of the sheet intake portion 7 of the sorter 200, as an example, it will be readily appreciated that the positions may be reversed.

It will be further appreciated that the first sheet processing unit and the second sheet processing unit of the present invention are not restricted to the combination of the photocopying machine and the sorter, as in the above-described embodiment, but they may be modified to the combination of other sheet processing units.

Although the proper positional adjustment of the sheet intake portion of the present invention relative to the sheet discharging portion of the copying machine cannot be adequately performed, in the above embodiment, when the operator connects the sheet conveyor joint mechanism to the copying machine side (its positional adjustment can be made somewhat, however, by rotating the lower carrying plate 11), it will be noted that a sheet conveyor mechanism may include a sheet intake portion whose positional adjustment relative to the sheet discharging portion can be made. It will be further noted that if the sheet intake portion can be positionally adjusted, the sheet discharging portion whose positional adjustment cannot be performed may then be used.

As can be understood from the foregoing description, according to the present invention, a sheet conveyor joint mechanism is provided, by which a first sheet processing unit and a second sheet processing unit can be suitably connected to each other at whatever height the sheet discharging portion of the first sheet processing unit and the sheet intake portion of the second sheet processing unit may be positioned relative to one another. It is, therefore, unnecessary to prepare a new or special base for adjusting the height of, for example, a desk top type copying machine.

The present invention is not confined to the embodiment described above, but may be embodied or practiced in other various ways without departing from the spirit or practicality of the invention as disclosed.

What is claimed is:

1. A sheet conveyor joint mechanism for connecting a first sheet processing unit having a sheet discharging portion to a second sheet processing unit having a sheet intake portion, said sheet conveyor joint mechanism comprising:

a framework;

a sheet carrying mechanism provided in said framework, said sheet carrying mechanism having a sheet carrying path, said carrying path having a sheet intake portion which is positionally adjustable relative to said sheet discharging portion of said first sheet processing unit and/or a sheet discharging portion of the carrying path which is positionally adjustable relative to said sheet intake portion of said second sheet processing unit, wherein said sheet carrying mechanism is provided with first and second carrying plates and a separate positionally-fixed carrying plate, said first and second carrying plates being rotatably supported by first and second support shafts fitted to said framework, respectively, and securing means for securing said first and second carrying plates relative to said framework in a selected position during operation; and connection means for connecting said sheet conveyor joint mechanism to said first sheet processing unit and said second sheet processing unit.

2. A sheet conveyor joint mechanism according to claim 1, wherein said sheet carrying mechanism comprises a plurality of sheet carrying rollers which are rotatably mounted on third and fourth support shafts fitted to said framework, said rollers being mounted such that they protrude through a plurality of cut-out apertures provided in said first and second carrying plates and such that said carrying rollers of said first carrying plate and said carrying rollers of said second carrying plate are positioned opposite one another.

3. A sheet conveyor joint mechanism according to claim 2, wherein said third and fourth support shafts on which said carrying rollers are mounted are connected by rotation transmission means to said sheet discharging portion so that speed at which sheets are carried through said sheet carrying path is substantially equal to the speed at which sheets are discharged from said first sheet processing unit.

4. A sheet conveyor joint mechanism according to claim 1, wherein said framework has an upper portion which is upwardly openable about a hinge shaft, wherein said fixed carrying plate is mounted to said upper portion.

5. A sheet conveyor joint mechanism according to claim 1, wherein said second carrying plate is rotatably held by a second bracket so that said second carrying plate is rotatable about said second support shaft which is disposed apart from said second carrying plate at a predetermined distance, wherein said first carrying plate is held by a first bracket so that said first carrying plate is rotatable about said first support shafts which are disposed at a position adjacent to a downstream end of said positionally fixed carrying plate in a sheet conveying direction.

6. A sheet conveyor joint mechanism according to claim 5, wherein said second bracket is provided with protruding members, said framework having side plates each having a slot by which said protruding member is guided, and said securing means is a screw for clamping the peripheral edge of said slot and said protruding member.

7. A sheet conveyor joint mechanism according to claim 5, wherein said carrying path is formed by said first and second carrying plates with first and second rollers positioned opposite one another within said carrying path, said first roller being supported by said first bracket uprightly provided on said first carrying plate, and said second roller being supported by said second bracket uprightly provided on said second carrying plate.

8. A sheet conveyor joint mechanism according to claim 7, wherein said second carrying plate and a down stream end of said first carrying plate in a sheet conveying direction are slidably supported in such a manner that the distance between said first and second carrying plates is kept constant.

9. A sheet conveyor joint mechanism according to claim 8, wherein said first and second rollers are rotatably mounted on third and fourth support shafts which are fitted to said framework, said rollers being mounted such that they protrude through a plurality of cut-out apertures provided in said first and second carrying plates and such that said first roller of said first carrying plate and said second roller of said second carrying plate are positioned opposite one another.

10. A sheet conveyor joint mechanism according to claim 9, wherein said third and forth support shafts on which said first and second rollers are mounted are connected by rotation transmission means to said sheet discharging portion so that the speed at which sheets are carried through said sheet carrying path is substantially equal to the speed at which sheets are discharged from said first sheet processing unit.

11. A sheet conveyor joint mechanism according to claim 1, wherein said first sheet processing unit is a copying machine and said second sheet processing unit is a sorter.

12. A sheet conveyor joint mechanism according to claim 1, wherein a unit portion is formed at a sheet discharge side of said first sheet processing unit in such a manner that said unit portion is rotatable about a rotation support shaft together with said sheet conveyor joint mechanism.

13. A sheet conveyor joint mechanism according to claim 1, wherein said framework comprising:

a bottom face resting on a spring which is provided on said first sheet processing unit so as to apply an upward spring force, a protrusion placed on a base portion of said first sheet processing unit; and securing means for securing said sheet conveyor joint mechanism to a sheet discharging side of said first sheet processing unit.

14. A sheet conveyor joint mechanism according to claim 13, wherein a unit portion is formed at said sheet discharge side of said first sheet processing unit in such a manner that said unit portion is rotatable about a rotation support shaft together with said sheet conveyor joint mechanism.

15. A sheet conveyor joint mechanism according to claim 1, wherein said first and second carrying plates move relative to one another as said sheet conveyor joint mechanism is positionally adjusted, such that said sheet carrying path becomes longer as the vertical separation between said sheet discharging portion of said first sheet processing unit and said sheet intake portion of said second sheet processing unit increases.

* * * * *